US006405965B2

(12) United States Patent
Flamm

(10) Patent No.: US 6,405,965 B2
(45) Date of Patent: Jun. 18, 2002

(54) METHOD OF WINDING CHEESES

(75) Inventor: Franz-Josef Flamm, Stolberg (DE)

(73) Assignee: W. Schlafhorst AG & Co. (DE)

( * ) Notice: Subject to any disclaimer, the term of this patent is extended or adjusted under 35 U.S.C. 154(b) by 20 days.

(21) Appl. No.: 09/748,677

(22) Filed: Dec. 22, 2000

(30) Foreign Application Priority Data

Dec. 22, 1999 (DE) ..... 199 61 982

(51) Int. Cl.[7] ..... B65H 54/38

(52) U.S. Cl. ..... 242/477.4; 242/477.6; 242/477.8

(58) Field of Search ..... 242/477.4, 477.5, 242/477.6, 477.7, 477.8

(56) References Cited

U.S. PATENT DOCUMENTS

| | | | | |
|---|---|---|---|---|
| 4,447,955 A | | 5/1984 | Stutz et al. | 702/97 |
| 4,805,844 A | | 2/1989 | Hermanns et al. | 242/486.3 |
| 4,964,582 A | | 10/1990 | Hermanns et al. | 242/485.1 |
| 5,086,984 A | | 2/1992 | Turek et al. | 242/470 |
| 5,090,633 A | * | 2/1992 | Ohashi | 242/477.4 |
| 5,595,351 A | * | 1/1997 | Haasen | 242/477.6 |
| 5,725,164 A | * | 3/1998 | Binner | 242/477.6 |
| 5,823,460 A | * | 10/1998 | Hermanns | 242/485.7 |
| 5,826,815 A | | 10/1998 | Hermanns et al. | 242/477.8 |
| 5,857,638 A | * | 1/1999 | Hermanns et al. | 242/477.6 |
| 6,283,401 B1 | * | 9/2001 | Lieber et al. | 242/477.2 |

FOREIGN PATENT DOCUMENTS

| | | |
|---|---|---|
| DE | 32 42 318 A1 | 6/1983 |
| DE | 37 03 869 A1 | 8/1988 |
| DE | 38 10 365 A1 | 10/1989 |
| DE | 43 39 217 A1 | 5/1995 |
| DE | 196 25 510 A1 | 1/1998 |
| DE | 196 25 511 A1 | 1/1998 |

OTHER PUBLICATIONS

German Search Report.

* cited by examiner

*Primary Examiner*—Michael R. Mansen
*Assistant Examiner*—Minh-Chau Pham
(74) *Attorney, Agent, or Firm*—Kennedy Covington Lobdell & Hickman, LLP

(57) ABSTRACT

In the winding of cheeses with a random pattern in a bobbin winding machine, a pattern disruption is performed during a passage through a pattern zone, and the actual diameter of the cheese (10) is determined by calculating the course of the increase of the cheese diameter to be expected and adding the expected increases in diameter occurring while winding through the pattern zones to the diameter of the cheese (10) calculated prior to reaching the pattern zone from the ratio of the number of revolutions of the cheese (10) and the winding drum (13) to the diameter of the winding drum (13).

6 Claims, 1 Drawing Sheet

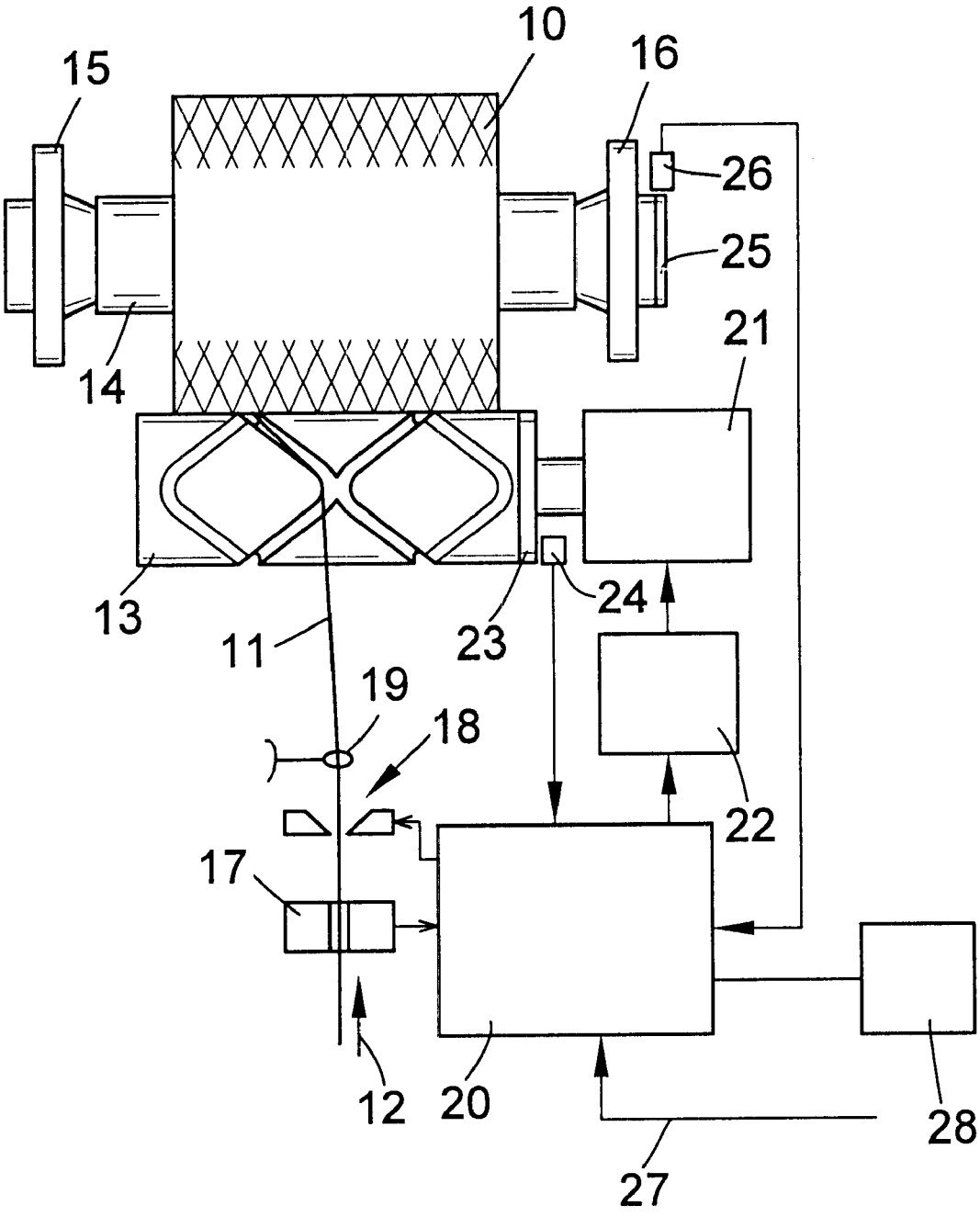
10
15
16
26
25
21
14
13
11
23
24
19
18
22
17
12
20
28
27

METHOD OF WINDING CHEESES

CROSS-REFERENCES TO RELATED APPLICATIONS

This application claims the benefit of German patent application No. 199 61 982.4, filed Dec. 22, 1999, herein incorporated by reference.

FIELD OF THE INVENTION

The present invention relates to a method of winding textile yarn packages of the type commonly referred to as cheeses in random windings. More particularly, the present invention relates to the performance of such a method on a bobbin winding machine having multiple winding stations (also referred to as winding heads) each having a winding drum for friction driving of a cheese being wound, and a means for generating slippage between the cheese and the winding drum for preventing pattern winding in possible pattern zones, wherein the diameter of the cheese is calculated from the known diameter of the winding drum and the measured numbers of revolutions of the winding drum and of the cheese.

BACKGROUND OF THE INVENTION

The basic methodology described above is generally known (e.g., German Patent Publication DE 43 39 217 A1). In such method, the calculation of the cheese diameter is used, for example, for determining the time for exchanging the cheese for an empty tube as a function of the diameter. It is also known in connection with this method to determine the exchange of the cheese for an empty tube as a function of the length of the yarn which has been wound onto the cheese. Here, the length of the wound-up yarn is determined by counting the revolutions of the winding drum, which are multiplied by a known yarn length fed in the course of one revolution of the winding drum. The generation of a slippage in possible pattern zones is caused by switching on and off a motor which drives the winding drum. Within a preset range of the number of drum revolutions, the number of revolutions of the winding drum is relatively rapidly increased from the lower limit to the upper limit by turning on the motor, after which the motor is switched off again until the lower limit has been reached. Slippage is created during the acceleration of the motor.

The cheese is seated in a pivotable creel and is pressed against the winding drum at a bearing pressure. In an older, but yet unpublished patent application (German Patent Application DE 198 29 597 A1,) it is disclosed to lower the bearing pressure for generating slippage in the course of winding through pattern zones, which step can be perform alone or in connection with switching off and on the motor.

If in the course of such a method, it is intended to perform the exchange of the cheese independently of a nominal yarn length, this is relatively free of problems. Slippage does not play a decisive role in such case and, if needed, can also be taken into account by means of correction factors, which adjust the result of the speed sensor, for example an incremental counter, by the amount of slippage.

However, problems arise if it is intended to perform an exchange of the cheese as a function of the diameter, specifically if the diameter which can be set and at which a winding head should be stopped is reached within a pattern zone. In this case, the calculation of the diameter of the cheese based upon the actual number of revolutions of the cheese and the winding drum in conjunction with the known diameter of the winding drum can lead to errors of several millimeters. This case occurs quite often, because the time required for the passage through a pattern zone can be up to several minutes.

SUMMARY OF THE INVENTION

It is accordingly an object of the present invention to improve the winding methodology of the type described above in such a way that a more accurate determination of the cheese diameter is possible even in pattern zones, whereby it is possible to turn off the winding head at a predetermined diameter of the cheese.

In accordance with the present invention, the actual diameter of the cheese during the passage through a pattern zone is determined by calculating the course of the increase of the cheese diameter to be expected and adding the diameter increases resulting during the passage through the pattern zone to the diameter of the cheese calculated prior to reaching the pattern zone from the ratio of the numbers of revolutions of the cheese and the winding drum to the diameter of the winding drum.

In this way, it is possible to draw relatively accurate conclusions regarding the actual diameter of the cheese even during the passage through the pattern zone and, if required, to shut down the respective winding head when a predetermined diameter has been reached.

In accordance with one feature of the invention, the course of the increase of the diameter of the cheese over time is calculated, and the time in the course of the passage through a pattern is registered. It is thus possible by means of the detected length of time to draw relatively accurate conclusions regarding the diameter of the cheese present during this period of time. It is then possible to preset a length of time at which the nominal cheese diameter is expected to be reached and to shut down the winding head at the end of this period of time.

In another further development of the invention, the course of the increase of the diameter of the cheese is calculated from the ratio of the wound-up yarn length and the calculated diameter, and during a passage through a pattern zone the length of yarn wound up is registered. This process can be attained simply by determining the length of wound-up yarn by means of registering the revolutions of the winding drum. In this case, it is assumed that the length of yarn or thread moved per revolution of the winding drum is known. If in accordance with this feature the nominal diameter of the cheese is reached during the passage through a pattern zone, it is the result of the diameter calculated prior to reaching the pattern zone and a predeterminable number of revolutions of the winding drum.

The diameter calculated from the course of the increase to be expected is used for outputting the actual diameter of the cheese finished in the course of the passage through the pattern zone. It is possible in this way to prevent the association of incorrect or erroneous diameter information with such cheeses. This is also advantageous when the exchange of the cheese is to be performed as a function of a nominal yarn length. The output of the diameter can take place in the form of a printout. Further output options may also be to show the diameter on a display or by means of a monitor.

Further characteristics and advantages of the invention will be described and understood from the following description of an exemplary embodiment with reference to the accompanying drawing.

BRIEF DESCRIPTION OF THE DRAWINGS

The single drawing shows the upper area of the winding head with the associated control in a largely schematic representation.

DETAILED DESCRIPTION OF THE PREFERRED EMBODIMENT

Referring now to the accompanying drawing, a bobbin winding machine has a plurality of winding heads, which operate independently from each other to a large degree, on each one of which a cheese 10 is being wound. A yarn 11, which is drawn off a spinning bobbin, not represented, in the direction of the arrow 12, is wound on the cheese 10. The lengths of yarn from several spinning bobbins are successively combined into the cheese 10.

The cheese 10 is driven by a winding drum 13 through friction he spinning tube 14 of the cheese 10 is held between cone plates 15, 16 on the arms of a creel, which is seated so that it is pivotable on an axis extending parallel with the axis of the winding drum 13.

The winding drum 13 is provided with a so-called reverse-threaded groove, by means of which the incoming yarn 11 is traversed back and forth along the cheese in the transverse direction while being placed thereon to form so-called random windings. During travel to the winding drum 13, the yarn 11 is passed through an electronic yarn cleaner 17, a cutting device 18 and a yarn guide 19. The yarn 11 is checked for defects (e.g., thick or thin places), which are cleaned out of the yarn when preset tolerance levels are exceeded, in the yarn cleaner 17. The values for the yarn 11 determined by the yarn cleaner 17 are transmitted to a winding head computer 20, which compares these values with preset values input into the winding head computer 20 from a central machine computer. In case of impermissible deviations, the cutting device 18 is operated. The piece of yarn with the impermissible yarn defect is cut out of the yarn. in a known manner, after which a slice or other form of yarn connection is reestablished, under the control of the winding head computer 20, and the winding process is started again.

The winding drum 13 is driven by means of an electric motor 21, whose number of revolutions is preset by means of a frequency converter 22. A speed sensor is assigned to the winding drum 13 and is connected to the winding head computer 20. The speed sensor consists, for example, of a magnet wheel 23 and a Hall sensor 24. Moreover, the number of revolutions of the cheese 10 is detected and is input into the winding head computer 20. A magnet wheel 25, to which a Hall sensor 26 is assigned, is attached to the cone plate 16 for this purpose.

Operating conditions, which are uniform for all winding heads, are preset by means of a machine computer in the winding head computer 20, as indicated by the input 27. The set conditions are, for example, the winding speed, i.e. the number of revolutions of the winding drum 13, the tolerances for the yarn cleaner 17 and, if required, also the values to be set in a tension regulating unit, not represented, which regulates the winding tension. If the bearing pressure between the cheese 10 and the winding drum 13 is controlled, a basic setting for this condition is also preset by the machine computer. The winding head computer 20 itself then varies the operation of the respective winding head as a function of the working conditions respectively prevailing there at, for example of the unwinding state of the spinning bobbin and of the state of winding or the size of the cheese 10, or the like.

In particular, the winding head computer 20 also determines a so-called pattern disruption, by means of which the already known possible pattern zones are prevented. To this end it is provided, for example, that the winding head computer switches the motor 21 continuously on and off between tolerance limits, wherein, when the lower tolerance limit has been reached, the motel is switched on and accelerated so strongly that slippage between the winding drum 13 and the cheese 10 is created, after which the motor 21 is switched off when the upper tolerance limit has been reached, so that the number of revolutions or angular velocity of the winding drum 13, together with the cheese 10 then driven without slippage, falls to the lower tolerance limit. To achieve a pattern disruption by means of slippage between the winding drum 13 and the cheese 10, it is furthermore possible to vary the bearing pressure of the cheese 10 on the winding drum 13, for which purpose the creel can be provided with a weighting device, not represented, which is controlled by the winding head computer 20 and which determines the bearing pressure between the cheese 10 and the winding drum 13.

Based on the data from the speed sensor 23, 24 of the winding drum 13, and the speed sensor 25, 26 of the cheese 10, the winding head computer 20 can calculate the actual diameter of the cheese 10 at any time, using the known diameter of the winding drum 13. It is possible in this way to determine the point at which a preset diameter of the cheese 10 has been reached and thereupon to perform a bobbin exchange. For example, the winding head is switched off for this purpose, i.e. the drive motor 21 is stopped. In this manner, it is possible to produce cheeses 10 of identical diameters at all winding heads of a bobbin winding machine.

However, this calculation of the diameter of the cheese 10 contains relatively large errors if a pattern zone lies within the range of the nominal diameter of the cheese 10, and a pattern disruption is accordingly performed.

In order to permit the most accurate determination possible of the diameter of the cheese 10 even in this case, the calculation of the diameter of the cheese 10 on the basis of the number of revolutions or angular velocities of the winding drum 13 and the cheese 10, as well as the known diameter of the winding drum 13, is supplemented by further steps. To this end, the increase of the diameter of the cheese to be expected in the pattern zone is calculated on the basis of values reached prior to entering the pattern zone, and is added to the diameter of the cheese 10, which was calculated prior to reaching the pattern zone in the manner previously described.

It is possible, for example, to calculate the course of the increase of the diameter by means of the continuous calculation of the diameter of the cheese 10 based on the diameter of the winding drum 13 and the characteristics of the number of revolutions, and to place it into a relationship with a measured time, so that the increase in the diameter of the cheese 10 over time is known. It is then possible to detect when a nominal diameter, which is located in a pattern zone, has been reached, in that the diameter prior to reaching the pattern zone is calculated and the increase in diameter, which is contained within a period of time which can be precalculated, is then added to it, so that the winding head is switched off at the end of this period of time. If the increase of the diameter of the cheese 10 per unit of time is calculated shortly before the pattern zone has been red, the possible error is relatively small. If necessary, it is of course also possible to take into account that, with an increase in the bobbin diameter, the increase of the diameter per unit of time becomes less.

With winding heads of the type described, the length of yarn conveyed and wound on the cheese 10 per revolution of the winding drum 13 is known. This knowledge can also be utilized for determining the diameter of a cheese 10 when performing a pattern disruption in a pattern zone. To this end, the winding station computer 20 calculates how great a length of yarn is required in a zone free of slippage for increasing the diameter of the cheese by a predetermined unit of measurement, for example by one millimeter. This is accomplished in such a way that the diameter of the cheese 10 is continuously calculated, based on the characteristics of the number of revolutions and the known diameter of the winding drum 13, wherein the yarn length required for increasing the diameter of the cheese 10 by one unit of measurement, for example one millimeter, is determined at the same time. The length of yarn wound onto the cheese in the pattern zone can then be detected by counting the revolutions of the winding drum. It is then possible to exactly calculate the diameter of the cheese 10 in the slippage-free phase prior to reaching a pattern zone, and then to determine how many revolutions of the winding drum 13 will be still required to attain the nominal diameter of the cheese 10 thereafter. If the ratio of the yarn length to the increase of the diameter of the cheese 10 shortly prior to reaching the pattern zone is calculated, the subsequently possible error is relatively small. However, it is also possible to take into consideration that, along with an increasing diameter of the cheese 10, the ratio of yarn length to the increase of the diameter changes.

Even if the exchange of the cheese 10 is performed as a function of a nominal yarn length, and the exact diameter of the cheese 10 is not required for triggering the exchange, relatively large errors in the determination of the diameter of the cheese produced during a passage through a pattern zone are undesirable. In this case as well, the diameter determined from the expected course of the increase is also used for outputting the actual diameter. Outputting of the diameter is performed as a print-out by means of the printer 28. It is alternatively or additionally possible to provide the output in a manner not represented in the form of a visual display or by means of a monitor.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method of winding cheeses in random windings on a bobbin winding machine with multiple winding stations each having a winding drum for friction driving of a cheese being wound, and a means for generating slippage between the cheese and the winding drum for preventing pattern winding in possible pattern zones, wherein the diameter of the cheese is calculated from the known diameter of the winding drum and the measured numbers of revolutions of the winding drum and of the cheese, said method comprising determining the actual diameter of the cheese during winding through a pattern zone by determining a course of the increase of the cheese diameter to be expected in the pattern zone and adding the expected course of diameter increase in the pattern zone to the diameter of the cheese calculated prior to reaching the pattern zone from a ratio of the number of revolutions of the cheese and the winding drum to the diameter of the winding drum.

2. The method in accordance with claim 1, characterized in that the course of the increase of the diameter of the cheese over time is calculated, and the time period in the course of the winding through the pattern zone is registered.

3. The method in accordance with claim 1, characterized in that the course of the increase of the diameter of the cheese is calculated from a ratio of the yarn length wound onto the cheese and the calculated diameter, and during a passage through the pattern zone, the length of yarn wound onto the cheese is registered.

4. The method in accordance with claim 3, characterized in that the length of yarn wound onto the cheese is determined by means of registering the revolutions of the winding drum.

5. The method in accordance with claim 1, characterized in that the diameter calculated from the expected course of cheese diameter increase in the pattern zone is used to output the actual diameter of the cheese finished during winding through the pattern zone.

6. The method in accordance with claim 5, characterized in that the output of the diameter comprises a print-out.

* * * * *